US006666709B2

(12) United States Patent
Andresen et al.

(10) Patent No.: US 6,666,709 B2
(45) Date of Patent: Dec. 23, 2003

(54) ELECTRICAL CONNECTING DEVICE

(75) Inventors: Jens Andresen, Blomberg (DE); Bernd Behling, Steinheim (DE); Ralf Feldner, Detmold (DE); Bernd Horrmeyer, Oldenburg (DE)

(73) Assignee: Phoenix Contact GmbH & Co., Blomberg (DE)

( * ) Notice: Subject to any disclaimer, the term of this patent is extended or adjusted under 35 U.S.C. 154(b) by 0 days.

(21) Appl. No.: 10/070,245

(22) PCT Filed: Jul. 3, 2001

(86) PCT No.: PCT/EP01/07609

§ 371 (c)(1),
(2), (4) Date: Mar. 4, 2002

(87) PCT Pub. No.: WO02/03505

PCT Pub. Date: Jan. 10, 2002

(65) Prior Publication Data

US 2002/0123262 A1 Sep. 5, 2002

(30) Foreign Application Priority Data

Jul. 3, 2000 (DE) ..... 100 31 341

(51) Int. Cl.[7] ..... H01R 13/58
(52) U.S. Cl. ..... 439/467
(58) Field of Search ..... 439/357, 358, 439/465, 467

(56) References Cited

U.S. PATENT DOCUMENTS 3,569,914 A * 3/1971 Taylor et al. ..... 439/467
4,139,727 A * 2/1979 Kuballa ..... 174/261
4,460,230 A 7/1984 McKee et al.
5,538,438 A 7/1996 Orlando
5,545,054 A * 8/1996 Benes et al. ..... 439/467
6,056,578 A * 5/2000 Lin ..... 439/358
2001/0016450 A1 8/2001 Gutris

FOREIGN PATENT DOCUMENTS

NL 1 002 900 C 10/1997

OTHER PUBLICATIONS

G. Beaujeu et al., Strain Relief Package for Card Cables, Mar. 1983, XP–002183179, IBM Technical Disclosure Bulletin, vol. 25, NR. 10, Mar. 1, 1983, The Whole Document, p. 5340.

* cited by examiner

*Primary Examiner*—Renee Luebke
*Assistant Examiner*—Ann McCamey
(74) *Attorney, Agent, or Firm*—Nixon Peabody LLP; David S. Safran

(57) ABSTRACT

A connecting device for connecting an electrical cable to an electrical device is provided. The electrical cable is connected to a plug connector, preferably of the RJ-45 plug configuration, for plugging into a corresponding socket of the electrical device. The connecting device is easy to assembly and ensures that the electrical cable and the plug connector are protected from mechanical damage. The electrical cable can be introduced into a housing together with the plug connector and maintained therein in this introduced state. The electrical cable, or the plug connector that is connected to the electrical cable, can be fixed to the socket or to the electrical device by means of snap-in elements which are located on the housing.

10 Claims, 5 Drawing Sheets

ELECTRICAL CONNECTING DEVICE

BACKGROUND OF THE INVENTION

1. Field of the Invention

The invention relates to a terminal device for connection of an electrical cable to an electrical device, wherein the electrical cable is connected to a plug, especially a plug which has a RJ-45 plug pattern, for insertion into a corresponding socket of the electrical device.

2. Description of Related Art

Terminal devices for connecting an electrical cable to an electrical device, especially to a communications means, for example a computer, notebook or telephone system, are known. The electrical cable is easily connected to the electrical device by the electrical cable being connected to a plug and this plug being plugged into a corresponding socket on the electrical device. To simplify connection of the electrical cable to the electrical device, it is conventional for at least one end of the cable to be already connected to the plug. Known terminal devices consist on a standardized basis of a cable-side, eight-pin plug which is known in practice as a RJ-45 plug or Western plug and a corresponding device-side terminal socket. The plug is generally connected to the cable with al crimp connection technique, but can also be soldered to it. Generally the plug is fixed by a means of a catch arm when it is plugged into the socket, but can also be held by an attachment hook which is present on the socket or the electrical device or can be screwed to the electrical device by means of screws. In semi-industrial installation of devices with this terminal hardware, the unprotected terminal device can be damaged as a result of severe conditions and mechanical stresses.

SUMMARY OF THE INVENTION

It is therefore one object of the present invention to overcome the deficiencies of the prior art and to provide a terminal device which ensures both secure attachment of the electrical cable to the electrical device and also mechanical protection both of the electrical cable and also the plug with a low space requirement and low material cost.

The above object, and other objects, are achieved by providing a terminal device wherein that the electrical cable can be inserted together with the plug into the housing and is held in it in the inserted state, and wherein the electrical cable or the plug connected to the electrical cable can be immobilized on the socket or the electrical device by a catch device located on the housing. In one embodiment, the terminal device includes a housing which holds the cable which has been connectorized with the plug. This embodiment offers the advantage that the electrical cable and plug are protected by the housing against external effects and at the same time can be attached to the socket or the electrical device by the catch device located on the housing. Because the electrical cable together with the plug is held in the housing, the tensile forces acting on the cable are kept away both from the cable-plug connection site and also from the plug-socket connection site. The, terminal device is otherwise characterized by the fact that it can be easily retrofitted since the housing is a separate component which can be connected subsequently to a cable which has been connectorized with a plug.

Advantageously, the housing consists of a housing body and a housing cover, and the housing cover can be attached to the housing body such that the housing cover, after attachment to the housing body, is pivotally connected to it. In this way the electrical cable together with the plug can be especially easily inserted first into the housing body (the cable and plug can be connected to the socket before the housing cover is attached to the housing body) and then closed with a swiveling motion. The attachment of the housing cover to the housing body and the closing of the housing can advantageously be done especially easily by the housing body and the housing cover being connected to one another via a hinge. The hinge may be made in two parts and the housing cover may include hinge pins while the housing body has the corresponding hinge receptacles. Because the housing is made in two parts, and the hinge which connects the housing body to the housing cover is made in two parts, the cable and plug can be inserted into the housing body only, with the housing cover completely removed, and then the housing cover can be connected easily to the housing body by the execution of the hinge and then closed.

For quick and easy acceptance of the electrical cable and plug, the housing body has an elongated receiving space. The receiving space may include a roughly U-shaped cross section which corresponds essentially to the diameter of the electrical ;cable and the plug. Because the receiving space is thus adapted to the outside contours of the cable and plug, the cable of course being much longer than the receiving space, the cable and plug are supported by the side walls of the receiving space and thus importantly the cable-plug connection site is protected from damage.

The electrical cable and plug are further protected by the housing having a strain relief device and/or antislipping device for the inserted cable. Strain relief devices for electrical cables are commonplace and are generally attached either as a separate part within the housing or, for example, are screwed onto the housing in the form of a PG screw connection from the outside. In the terminal device of the invention, advantageously the strain relief device and/or antislipping device for the inserted cable is/are implemented directly by the housing itself. To do this, either only the housing body or only the housing cover are made accordingly, but preferably both the housing body and also the housing cover are made such that with the housing closed, the housing body and the housing cover jointly accomplish the strain relief for the inserted cable.

Advantageously, on the cable-side end of the receiving space, transversely to its lengthwise extension, elevations are formed on the housing body which project into the receiving space. In the position corresponding to the elevations, a shoulder is made on the housing cover and it extends perpendicular to the base surface of the housing cover such that the shoulder, with the housing closed, i.e. with the housing cover closed, projects into the receiving space. Thus, with the housing closed, the receiving space on its cable-side end is narrowed, on the one hand, by the elevations formed on the housing body, and on the other hand, by the shoulder formed on the housing cover.

In this way a cable which has been inserted into the housing body is clamped securely such that the forces acting on the end of the electrical cable projecting out of the housing are not transferred to the electrical cable-plug connection.

According to a last advantageous embodiment of the invention which will be briefly explained here, the hinge pins are made laterally on the shoulder of the housing cover and the hinge receptacles are made on the cable-side end of the housing body. In this way, on the one hand an especially simple and compact housing can be implemented, while on the other hand, simultaneously with closing of the housing cover, strain relief is accomplished since, when the housing cover is swiveled, the shoulder which is located vertically on the housing cover is swiveled into the receiving space.

In particular, there are a host of possibilities for embodying and developing the terminal device of the invention.

DETAILED DESCRIPTION OF THE INVENTION

The figures show a terminal device 1 for connecting an electrical cable 2 (FIGS. 2–5) to an electrical device (not shown), wherein the electrical cable 2 is already connected to a plug 3. The plug 3 is preferably a RJ-45 plug which is known also as a Western plug. To connect the electrical cable 2 to the electrical device, the plug 3 is plugged into a corresponding socket of the electrical device. The electrical cable 2, and the plug 3 which is connected to the electrical cable 2, can be protected against mechanical damage by a housing. The electrical cable 2 together with the plug 3 are inserted into the housing and held within the housing. A catch device or means 4 (FIG. 1) located on the housing prevents unwanted withdrawal of the housing, and thus also the plug 3, away from the electrical device.

Figure 3:
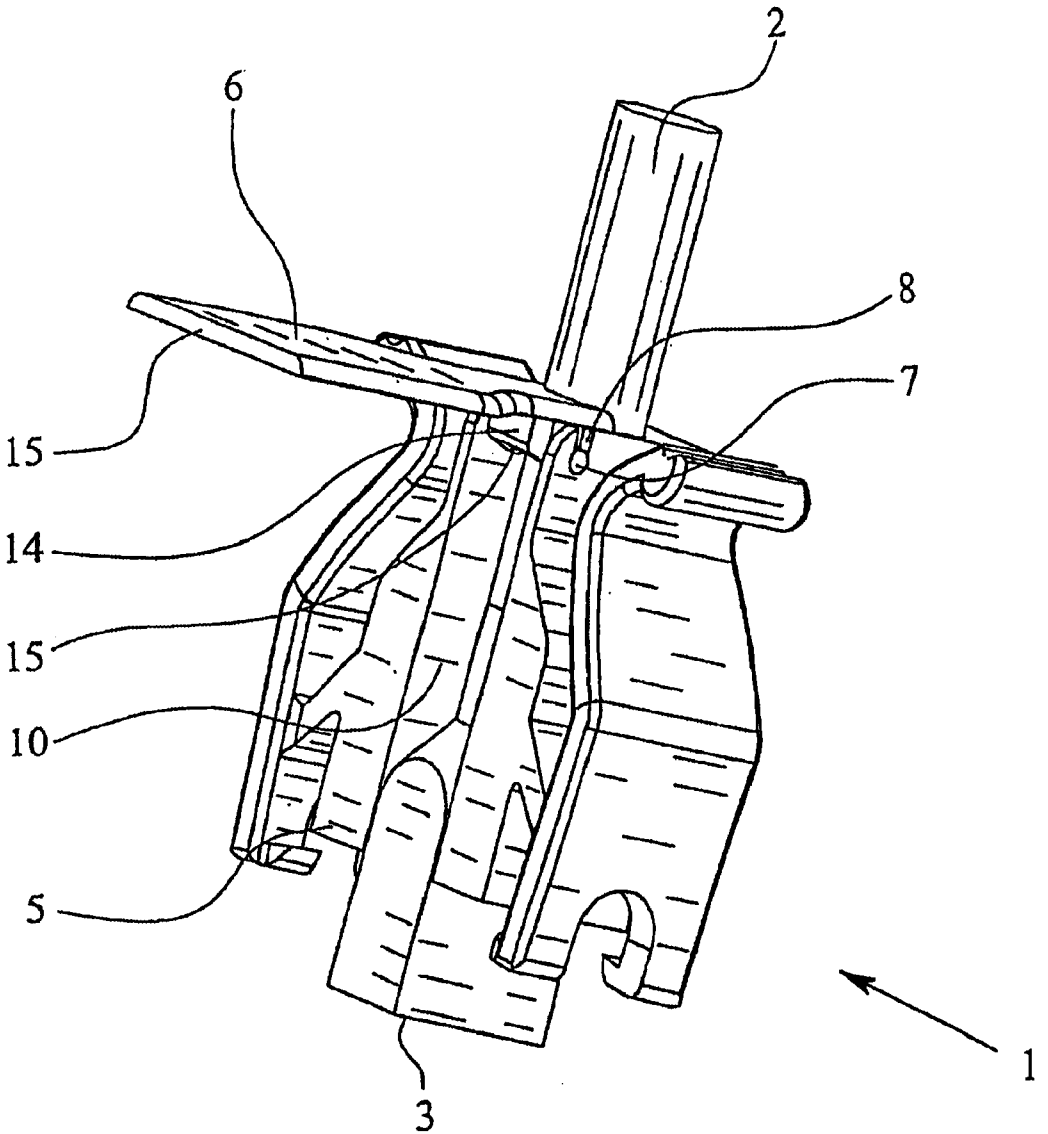
FIG. 3 shows a terminal device of the invention with the housing clover attached to the housing body, but still opened.
Figure 4:
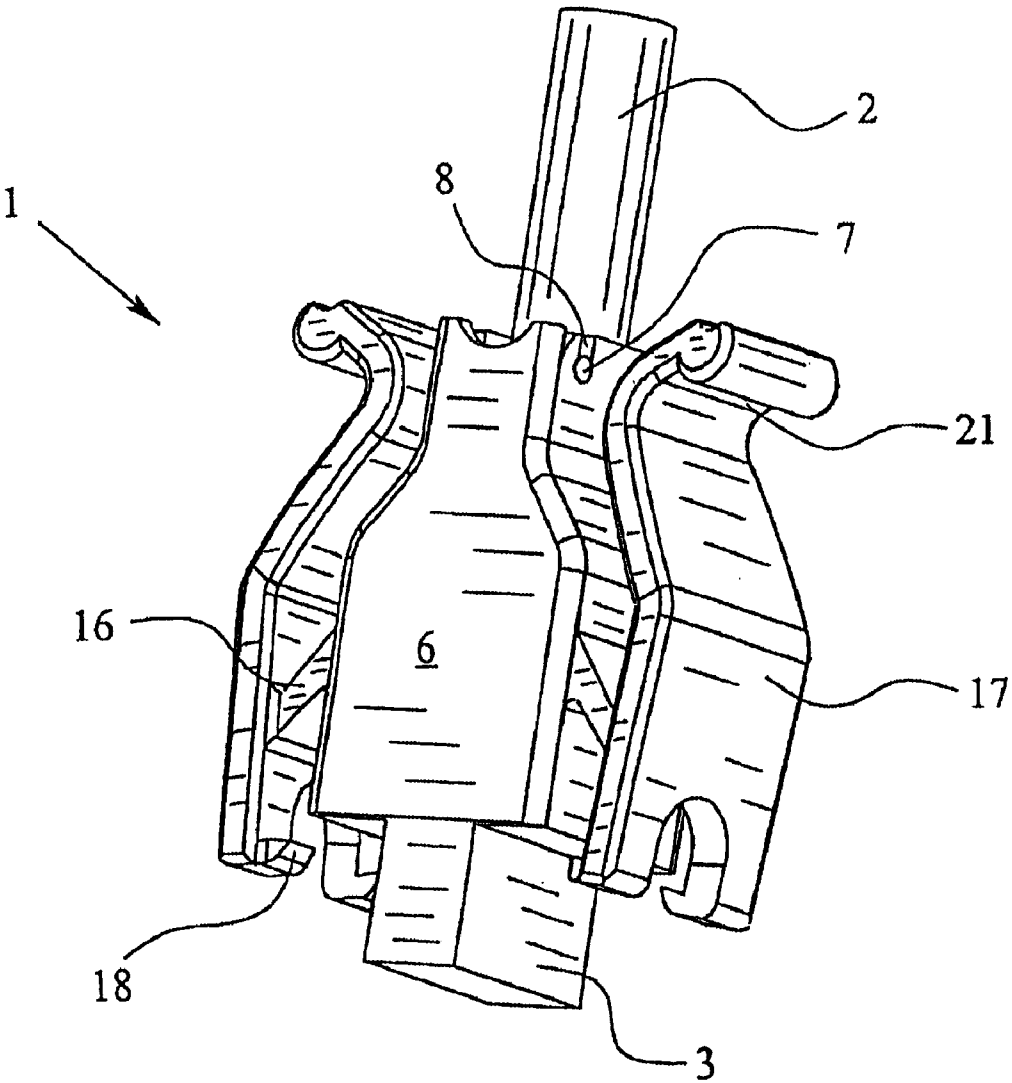
FIG. 4 shows the terminal device as shown in FIG. 3, but with the housing cover closed.
Figure 5:
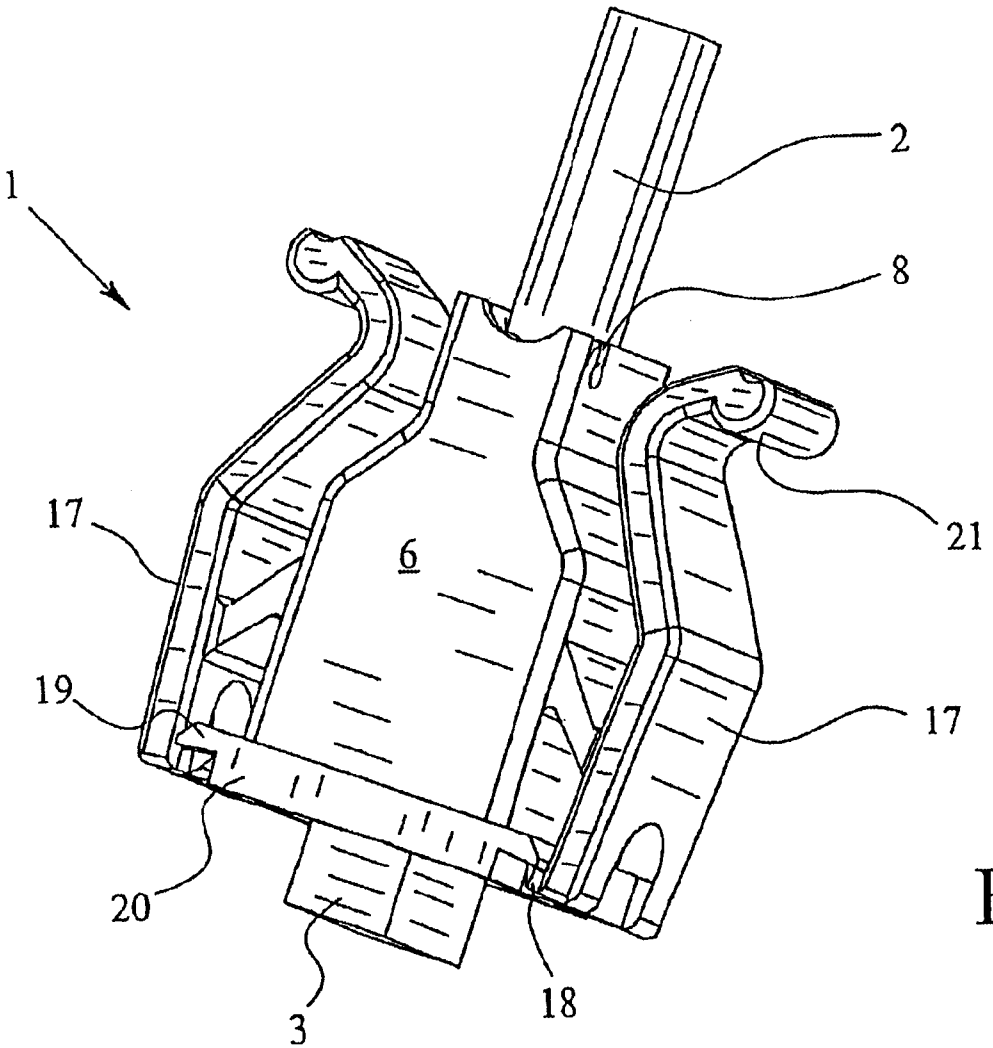
FIG. 5 shows the terminal device as shown in FIG. 4, attached to the housing of an electrical device shown only partially.

The installation of the terminal device 1 is especially simple because the housing is made in two parts, specifically out of a housing body 5 and a housing cover 6 (FIG. 3). For installation, simply the cable 2, preconnectorized, with the plug 3 must be inserted into the housing body 5, the housing cover 6 attached to the housing body 5 and then the housing cover closed by simply rotating it around the axis as shown in FIGS. 3 and 4. To do this, the housing has a dismountable, two-part hinge including hinge pins 7 located on the housing cover 6 and hinge receptacles 8, corresponding to the pins, on the housing body 5. Especially simple and prompt assembly of the terminal device 1 is possible by the two-part configuration both of the housing and also of the hinge and by the arrangement of the hinge pins 7 on the housing cover 6 and the hinge receptacles 8 on the housing body 5.

Figure 1:
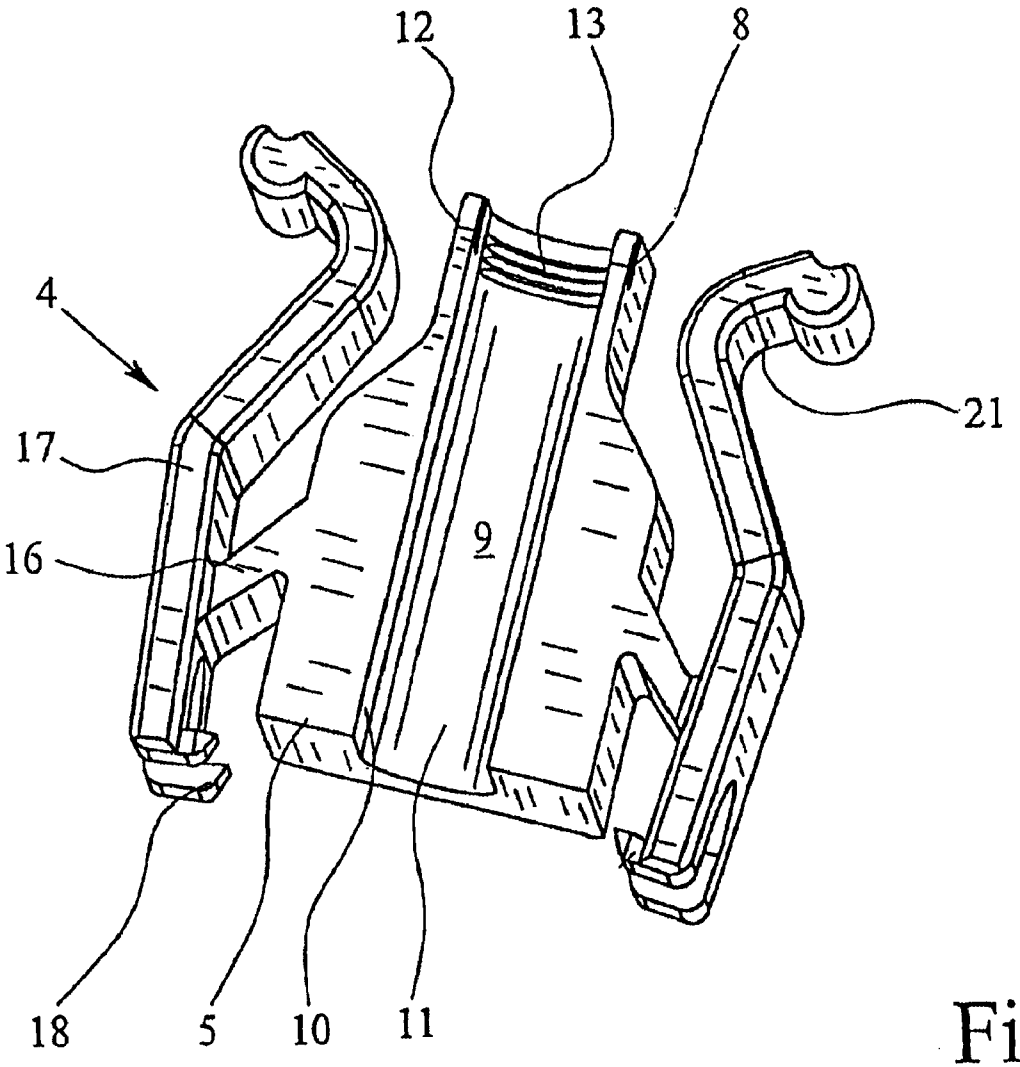
FIG. 1 shows an empty housing body of the terminal device of the invention.
Figure 2:
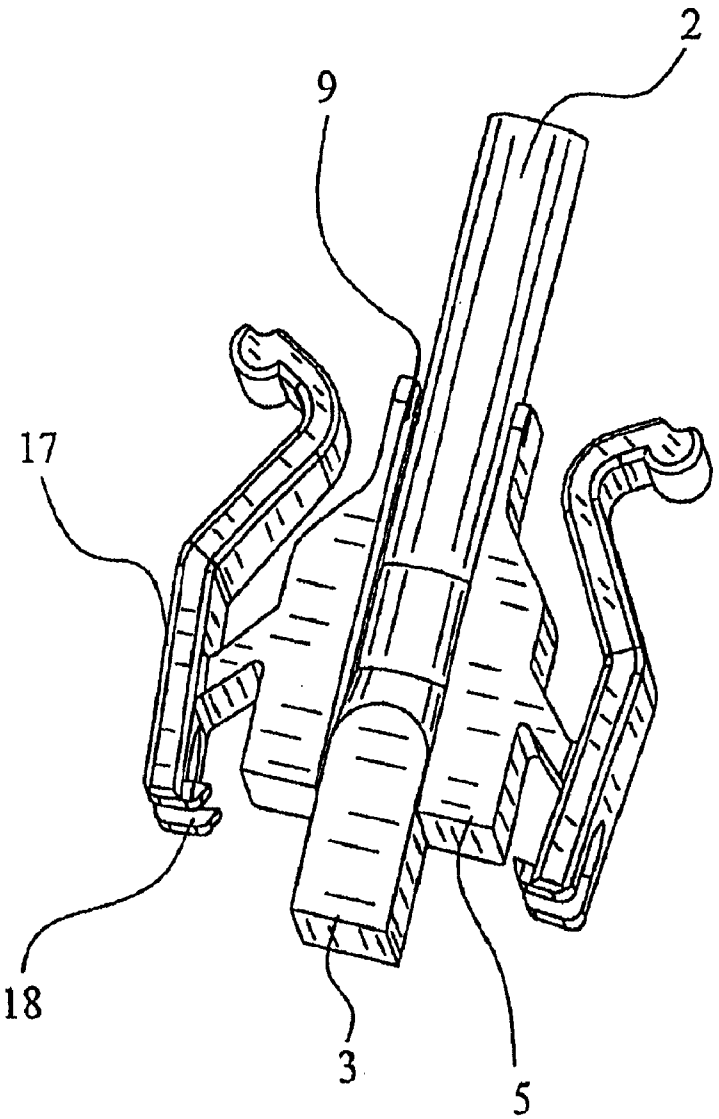
FIG. 2 shows the housing body as shown in FIG. 1 with an inserted cable preconnectorized with the plug.

As shown by FIGS. 1 and 2, the housing body 5 has an elongated receiving space 9 having a roughly U-shaped cross section. The U-shaped cross section of the receiving space 9 corresponds essentially to the diameter of the electrical cable 2 and the cross section of the plug 3. In other words, the receiving space 9 is dimensioned such that the electrical cable 2 intended for the terminal device 1 can be inserted with the plug 3 connected to it into the receiving space 9 of the housing body 5. The side walls 10 and the bottom 11 of the receiving space 9 are used as kink protection for the electrical cable 2 and the plug 3. In particular, kinking of the cable 2 at the critical transition to the plug 3 is thus prevented.

So that the electrical cable 2 is fixed and protected not only perpendicular to its lengthwise extension, the housing has a stress relief device. First, on the cable-side 12 end of the receiving space 9, transversely to its lengthwise extension, transverse elevations 13 (FIG. 1), which project into the receiving space 9, are formed on the housing body 5. The transverse elevations 13 are made and dimensioned such that they narrow the receiving space 9 only to such an extent that the electrical cable 2 can be inserted under pressure into the receiving space 9. The transverse elevations 13 thus provide for a press fit between the electrical cable 2 and the receiving space 9 on its cable-side end 12. With a correspondingly pointed execution of the transverse elevations 13, they can also crimp the jacket of the electrical cable 2. The transverse elevations 13 however are always dimensioned such that damage to the electrical cable 2 is prevented.

Corresponding to the location of the transverse elevations 13 on the housing body 5, a shoulder 14 (FIG. 3) is formed. The shoulder 14 extends perpendicular to the base surface of the housing cover 6 such that the shoulder 14, with the housing closed, i.e. with the housing cover 6 closed, projects into the receiving space 9. The arrangement of the shoulder 14 on the housing cover 6 corresponding to the location of the transverse!elevations 13, i.e. transversely to the lengthwise extension of the housing cover 6, results in the shoulder 14 always pressing the electrical cable 3 which has been inserted into the housing body 5 against the transverse elevations 13 with the housing cover 6 closed. By this fixed pressure of the electrical cable 2 against the transverse elevations 13, the terminal device 1 ensures not only protection against slippage, but strain relief of the electrical cable 2. The strain relief can be intensified by transverse elevations or grooves likewise being made on the lend face 15 of the shoulder 14. With the housing cover 6 closed, the interaction of the transverse elevations 13 in the housing body 5 and of the shoulder 14 on the housing cover 6, ensures effective stress relief of the electrical cable 2.

The terminal device 1 of the invention can be installed especially compactly and easily by the hinge pins 7 being made laterally on the shoulder 14 of the housing cover 6 and the hinge receptacles 8 being made on the cable-side end 12 of the housing body 5.

The individual steps of installing the terminal device 1 of the invention are shown in FIGS. 1 to 5. FIG. 1 shows an empty housing body 5 with a receiving space 9 and transverse elevations 13 located on the cable-side end 12 of the housing body 5. Because the housing body 5 is freely accessible from the top, the electrical cable 2 preconnectorized with the plug 3 can be inserted into the receiving space 9, regardless of whether the plug 3 is already connected to the socket or not. This state, with the cable 2 inserted into the housing body 5, is shown in FIG. 2.

Next, the housing cover 6 is connected to the housing body 5, for which the hinge pins 7 are simply snapped into the hinge receptacles 8. The housing cover 6 is vertical on the housing body 5 and thus also perpendicular to the lengthwise extension of the electrical cable 2. From this opened state of the housing shown in FIG. 3, the electrical terminal device 1 can be simply shifted into the closed state by folding up the housing cover 6. While the housing cover 6 is shifted out of its open position, which is vertical relative to the lengthwise extension of the electrical cable 2, into the horizontal position, the shoulder 14 is moved into the vertical position vice-versa out of the horizontal position. In the closed state of the housing cover 6, the shoulder 14, which runs perpendicular thereto, provides for the electrical cable 2 to be clamped between the transverse elevations 13 and the lend face 15 of the shoulder 14, with which strain relief of the electrical cable 2 is accomplished. The shoulder 14 is dimensioned in the same way as the transverse elevations 13 so that the electrical cable 2 is held relatively securely, but damage to the electrical cable 2 is prevented.

Unwanted opening of the housing cover 6 is prevented by the press fit between the shoulder 14 and the electrical cable 2. In addition, however, on the plug-side end of the housing body 5 or on the plug-side end of the housing cover 6, there can be suitable catch elements which are not shown. The housing cover 6 can be opened again only using a tool, for example a screwdriver. If subsequent opening of the housing is not wanted, the housing cover 6 can be cemented or welded to the housing body 5 for additional security.

The attachment of the completely assembled terminal device 1 shown in FIG. 4 to the electrical device can be done especially easily by the catch means 4 which are formed or positioned on the housing. The catch means 4 comprise two catch arms 17 which are connected to the housing body 5 via one crosspiece 16 each, and catch projections 18 located on the end side on the catch arms 17. The catch projections 18 are used to fit behind the corresponding projections 19 on the housing wall 20 of the electrical device. The catch means 4 are made to be detached by hand using a grip section 21 formed on leach catch arm 17. When the grip sections 21 are pressed together, the catch projections 18 move apart and the terminal device 1 can be withdrawn from the housing wall 20.

Preferably the ends of the catch projections 18 are bevelled so that the catch arms 17, and thus the catch projections 18, move apart when the terminal device 1 is pressed onto the housing wall 20 of the electrical device as a result of the elasticity of the catch arms 17.

We claim:

1. A terminal device for connection of an electrical cable to an electrical device, the electrical cable being connected to a plug for insertion into a corresponding socket of the electrical device, comprising:

a housing adapted to receive, and hold in place in an inserted state in the housing, the electrical cable and the plug;

wherein the housing is formed of two separate parts, said two separate parts being a housing body and a housing cover pivotally attached to the housing body in a detachable manner, wherein a catch means is located on the housing for fixing one of the electrical cable and the plug on one of the socket and the electrical device;

wherein the housing body includes an elongated receiving space bounded by a side wall having a roughly U-shaped cross section which corresponds essentially to a diameter of the electrical cable and the cross section of the plug and which provides lateral support for the cable and plug along the full length thereof; and wherein said plug is an RJ-45 type plug.

2. The device of claim 1, wherein the housing includes at least one of a strain relief device and an anti-slipping device for the inserted cable.

3. The device of claim 1, further including elevations formed on the housing body on the cable-side end of the receiving space transversely to its lengthwise extension, said elevations projecting into the receiving space.

4. The device of claim 1, wherein the catch means includes elastic catch arms having catch projections capable of positioning behind corresponding projections formed on at least one of the socket and the electrical device.

5. The device of claim 1, wherein the housing body and the housing cover are attached to one another via at least one hinge, the hinge being made in two parts including hinge pins formed on the housing cover and hinge receptacles formed on the housing body.

6. The device of claim 5, wherein a shoulder is formed on the housing cover, the shoulder extending perpendicular to the base surface of the housing cover such that the shoulder projects into the receiving space when the housing cover is closed, wherein the hinge pins are formed laterally on the shoulder of the housing cover and the hinge receptacles are formed on a cable-side end of the housing body.

7. The device of claim 1, wherein a shoulder is formed on the housing cover, the shoulder extending perpendicular to the base surface of the housing cover such-that the shoulder projects into the receiving space when the housing cover is closed.

8. The device of claim 7, wherein the shoulder runs transversely to the lengthwise extension of the housing cover, further including means for at least one of relieving strain and preventing slip of the cable formed on the end face of the shoulder.

9. The device of claim 8, wherein the means for at least one of relieving strain and preventing slip of the cable is positioned to interact with the elevations on the housing body.

10. The device of claim 8, wherein the means for at least one of relieving strain and preventing slip of the cable includes elevations.

* * * * *